US006250369B1

(12) United States Patent
Cassani et al.

(10) Patent No.: US 6,250,369 B1
(45) **Date of Patent: *Jun. 26, 2001**

(54) PLANT FOR PRESSURE CASTING SANITARY ARTICLES

(75) Inventors: Giuseppe Cassani, Imola; Reinhard Wegmann, Villafranca, both of (IT)

(73) Assignee: Sacmi Cooperativa Meccanici Imola S.C.R.L., Imola (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/005,506

(22) Filed: Jan. 12, 1998

(30) Foreign Application Priority Data

Jun. 17, 1997 (IT) ..... RE97A0042

(51) Int. Cl.[7] ..... B22D 33/04; B28D 1/26
(52) U.S. Cl. ..... 164/341; 425/84; 425/451.9
(58) Field of Search ..... 164/341, 137; 425/84, 85, 451.9, 453, 459

(56) References Cited

U.S. PATENT DOCUMENTS 5,622,727 * 4/1997 Cuman et al. ..... 425/84
5,645,863 * 7/1997 Cuman et al. ..... 425/84

FOREIGN PATENT DOCUMENTS 195 20 234 7/1996 (DE) .
298 01 197 U 5/1998 (DE) .

* cited by examiner

*Primary Examiner*—Kuang Y. Lin
*Assistant Examiner*—I.-H. Lin
(74) *Attorney, Agent, or Firm*—Birch, Stewart, Kolasch & Birch, LLP

(57) ABSTRACT

A pressure casting apparatus for molding sanitary articles which comprises a frame member, a lifting mechanism mounted in said frame member for up and down movement relative to said frame member, a plurality of molds positioned adjacent to each other and below the lifting mechanism, each mold being constructed form two lateral mold components which extend laterally from adjacent locking rods, an upper mold component and a lower mold component, said upper mold component being suspended from the lifting mechanism, the lateral mold components extending from opposite sides of the locking rod, and the lower mold components being disposed below said lateral mold components, said lateral mold components and said lower mold components being mounted for lateral movement within said frame members, and means for laterally compressing the lateral mold components and the lower mold components together, whereby the lateral mold components extending laterally from adjacent locking rods and an associated lower mold component combined with the lowering of the upper mold component to define the mold chamber used in the pressure casting operation.

12 Claims, 6 Drawing Sheets

PLANT FOR PRESSURE CASTING SANITARY ARTICLES

BACKGROUND OF THE INVENTION

The present invention relates to a plant for pressure casting sanitary articles such as water closet pans and bidets with an open or closed rinsing rim, which uses moulds of synthetic material.

More particularly, the present invention relates to a pressure casting plant for sanitary articles with several moulds arranged one next to another, each provided at least with one mould lower element, two mould lateral elements, and at least one mould upper element and/or at least one mould transverse element, this or these being positioned transverse to the longitudinal direction of the moulds arranged in a row.

Specifically, the moulds are arranged in a row with their mould lateral elements aligned, and which can be clamped in the alignment direction by two lateral cylinders, to hence form a mould group.

A plant of this type is described in the document EP-B1-0 557 995. In the pressure casting plant described in that document, mould-carrier carriage pairs are provided together with a clamping device for joining the mould elements together by clamping them.

The clamping device is positioned on a clamping frame separated from the mould-carrier carriage.

The clamping frame can be raised and lowered between an operating position and a parking position.

In a plant with at least 6 moulds, three respective pressure casting moulds are ready in the clamping frame to be put into operation. This means that three moulds are ready and clamped, and three products are cast.

The clamping frame, which can be orientated upwards and downwards about a positionable axis relative to the mould element guide, is then orientated upwards and the moulds together with the moulded products are withdrawn by a lifting device and placed on the resting surface.

In this case sixteen clamping devices are required for three moulds, and have to be slackened to withdraw the three formed products.

When the first three forms have been removed from the clamping frame and placed on the resting surface, the clamping frame is returned to its operating position to enclose the next mould elements to be prepared and clamped, and to cast three formed products which are turned and laid on a resting surface after the sixteen clamping devices have been released.

The document EP-0 569 855 describes a plant and process for pressure casting ceramic articles such as water closet bowls.

This plant comprises a longitudinal guide following an axial direction, and several moulds which can be moved along said guide and are provided respectively with at least two lateral elements, a base element, and at least one transverse element which can be moved transversely to the axial direction between the lateral elements, plus an axial clamping device.

The moulds are combined with a single clamping cage comprising transverse clamping devices to hold the mould lower element, the mould transverse element or elements and the lateral elements of each mould together.

Suitable means join the mould transverse elements to the relative transverse clamping devices.

The clamping cage is provided with one clamping frame for each mould, on which four transverse clamping devices are positioned, namely an upper, a rear, a lower and a front.

The front device is fixed on a side which can be moved vertically on the relative clamping frame, and raised and lowered. The clamping frame can be positioned in a return position for withdrawing the formed product and also in a parking position transverse to the axial direction. When the mould elements have been moved apart, the formed product is withdrawn by an extraction device of known construction, which grips it.

The two aforedescribed plants have a certain number of disadvantages.

In the case of the plant of EP-0 569 855, each mould is located in a clamping frame within a single clamping cage. These devices are equipped for simple clamping and slackening of the individual moulds. Each clamping frame is provided with 4 transverse clamping devices which have to be slackened during the extraction of the formed products to enable them to be withdrawn by a special gripper.

In the case of the plant described in EP-B1-0 557 995, the upper and mould lower element of the three moulds are respectively extracted, then the moulds with the formed products within them are rotated about a horizontal axis, and are laid on a parking surface.

The lateral moulds are then loosened to release the formed products, the mould elements are again brought together, and are then re-rotated within the plant.

Hence a number of different clamping devices located within the clamping frame and clamping cage have to be successively slackened and tightened during various processing stages for three moulds respectively.

SUMMARY OF THE INVENTION

An object of the invention is to provide a pressure casting plant for ceramic sanitary articles which is of simple construction and does not comprise complicated clamping devices.

A further object is to provide a pressure casting plant which enables the time for the clamping and slackening stage to be reduced to a minimum.

A further object is to provide a pressure casting plant which is perfectly compatible with the mechanical properties of moulds of synthetic material, which are characterised by a low elastic modulus and hence by substantial volume changes during plant clamping.

These objects are attained according to the present invention by a plant of the initially described type in which:

a) a vertically movable lifting beam is arranged above the moulds, b) for each mould the beam contains an upper cylinder to which the mould upper element (if present) is connected, c) mould lower elements for each mould are fixed to a lower plate and slidable on a lower cross-member in the plant axial direction, d) on the cross-member in the plant axial direction, namely between the lower plates, there are provided movable lateral element carriages on which, for each mould, vertical locking rods and the respective lateral elements of the adjacent moulds are fixed, e) the locking rods can be coupled at their upper end by coupling devices which are connected to the lifting beam by weight compensation devices, and can be coupled at their lower end to the lower plates, f) the mould group is positioned between lateral cross-members which can be moved in an axial direction on the lower cross-member and be fixed thereto, and on which the lifting beam engages during the clamping of the mould group, and finally g) the plant can be equipped with a locking device which is transverse both to the plant axis and to the direction of movement of the lifting beam.

The mould group is composed of at least two moulds, and can be clamped against one side of a fixed cross-member which is rigid with the lower cross-member.

The lateral cross-members are fixed by a vertically movable fixing device which can be moved hydraulically, pneumatically, electromechanically. Electromagnetically or the like, and which during the plant clamping stage rests against a stop provided in the lower cross-member.

The pressure casting plant is constructed such that on the lifting beam there rest the upper frames under which there are connected the upper cylinders, the rods of which are rigid with the upper plates, which are connected to the possible mould upper elements. The upper coupling devices into which the locking rods hook are provided in the upper frames.

The pressure casting plant is constructed such that while the lifting beam is engaged on the lateral cross-members and on the fixed cross-member, the upper frames, the upper cylinders, the upper plates, the mould upper elements and the upper coupling devices with the locking rods can move freely in the plant axial direction.

Below each lower plate there is a lateral element detachment device which is inactive when the mould group is clamped, and active against the carriages of the adjacent lateral elements when the moulds are slackened, so that these carriages become slightly detached from the lower plates. The moulds are hence slightly opened on slackening the plant, and the mould is separated from the cast products.

The detachment device can be a pneumatically operated scissor device, which can urge the scissor sides against the carriages of the adjacent lateral elements. The operation of said scissor device can be synchronized with that of the lateral cylinders and with the fixing device for the lateral cross-members.

To insert the possible inserts into the region of the rinsing rim, the moulds must be closed in the axial direction by moving the carriages of the lateral elements close to the lower plates clamped by the lateral cylinders.

To prepare the pressure casting plant, those plant components situated on the lower cross-member, ie the lower plates, the carriages for the lateral elements and the lateral cross-members, are brought together by electrical movement. After this the lifting beam is lowered and engaged on the lateral cross-members, which are then fixed to the lower cross-member.

This fixing can be snap-actuated hydraulically, pneumatically, electromechanically. Electromagnetically or in another manner.

The lateral cylinders are then pressurized to compress the thus formed mould group in an axial direction, until the locking rods on the lateral element carriage correspond in position with the upper coupling devices which rest on the lifting beam.

In this position the coupling devices interact with the locking rods, and are coupled together for example by pins.

The weight compensation devices are operated so as not to cause the weight of the upper frames with everything connected to them, and of the lower plates with everything connected to them, to act on the mould lateral elements.

Finally, the mould upper and lower elements are completely closed by pressurizing the upper cylinders. The mould lower elements resting on the lower plates are raised, by sliding rigid with the locking rods towards the lifting beam.

At this point the mould is completely closed.

The axial pressure is then increased by the lateral cylinders, until the moulds have been clamped with the necessary force also in an axial direction.

The pressure rise in the upper cylinders and lateral cylinders can be correlated.

Casting is effected at this point.

When the automatic casting process has ended, the pressure in the upper and lateral cylinders is firstly decreased and the weight compensation device deactivated.

The moulds are thus slackened, and the slide rods again slide downwards, until the lower element of the moulds again rests on the lower cross-member.

Having accomplished this, the locking rods are released from the lifting beam, the lateral cross-members are released and finally the lifting beam transporting the upper elements of all the moulds is shifted vertically upwards. The individual moulds are then separated by removing the lower plates by the lateral element carriages by making them slide on the lower cross-member in the axial direction of the casting plant. This process is facilitated by the fact that during the slackening of the plant the lateral element detachment devices positioned below the lower plates are activated so that at the moment in which the moulds are removed, they are already detached from the formed products.

During the slackening of the mould groups the lateral element detachment device lightly thrusts against the carriages of the adjacent lateral elements so that the moulds become opened.

After the moulds have been opened, the formed products freely rest on the mould lower element and can be withdrawn by a traditional extraction device.

After withdrawing all the formed products and axially returning the previously rinsed mould group, the possible inserts can be again inserted into the easily accessible open moulds.

A possible mould transverse element can be brought up close by a transverse carriage, which can be coupled to the lateral element carriage, and the moulds can be clamped with the aid of a further clamping device.

This mould transverse element is rigid with the rod of a transverse clamping cylinder.

The mould transverse elements are brought into contact with the lateral elements before the lateral cylinders are put under pressure, and the transverse cylinders clamp them, in a direction transverse to the axial direction.

The pressure increases in the transverse cylinders, lateral cylinders and upper cylinders can be mutually correlated.

The advantages of this inventive solution are a simple plant construction without the need for a complicated locking and clamping device.

For n moulds, the requirement is n upper cylinders, 4n locking rods,, two lateral cylinders and possibly n transverse cylinders. The time required for clamping and slackening the casting plant is considerably reduced as the locking is implemented automatically by compacting the moulds and lowering the lifting beam. It is sufficient simply to simultaneously tighten the two lateral cylinders, the upper cylinders and the possible transverse cylinders of each mould to hence obtain a high production rate ensuring a productivity increase over known plants.

The simple construction and handling allow rapid mould closure and locking before the casting process, and rapid mould release and opening thereafter. In this manner all the advantages of a casting process associated with the use of moulds of synthetic material can be exploited.

BRIEF DESCRIPTION OF THE DRAWINGS

The merits and the constructional characteristics of the present invention will be apparent from the ensuing description, illustrated by the accompanying drawings, wherein.

DETAILED DESCRIPTION OF THE INVENTION

Figure 1:
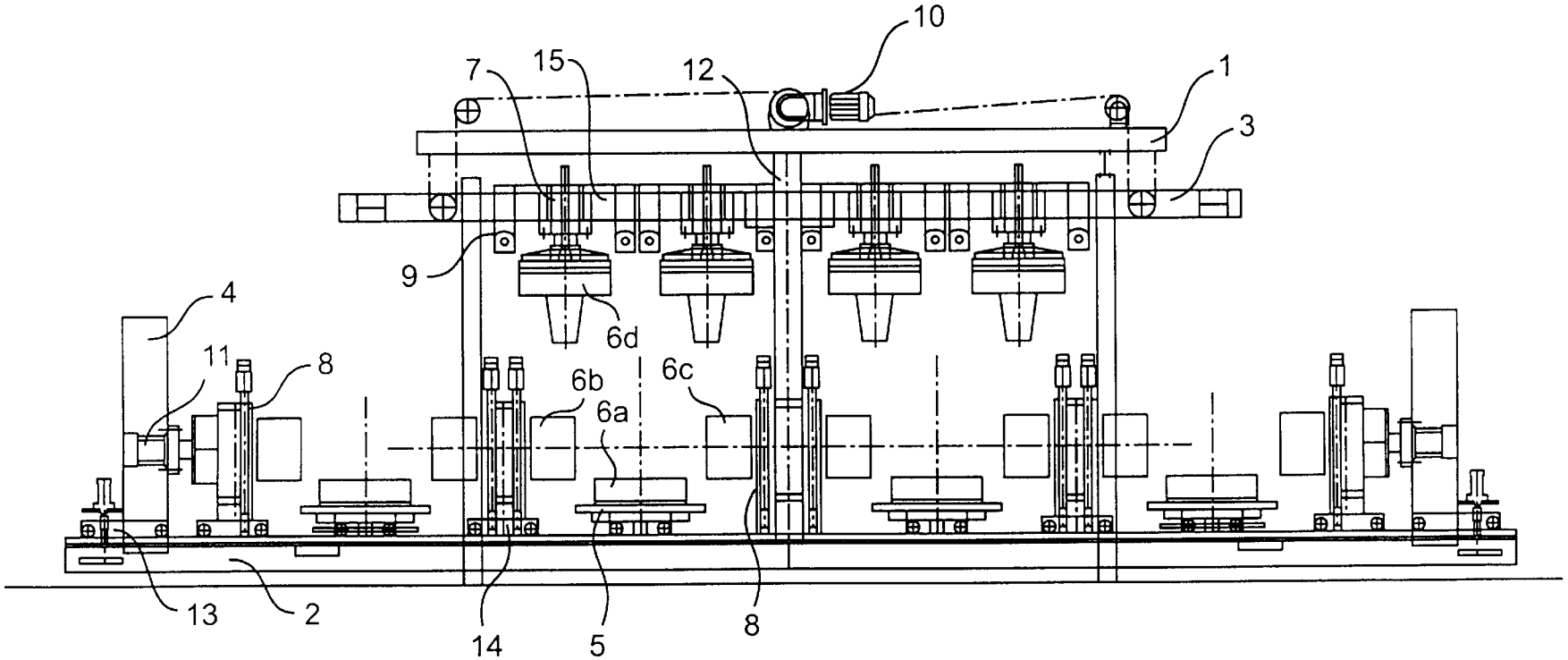
FIG. 1 is a front view of the casting plant according to the present invention.

FIG. 1 shows the casting plant of the invention in the open state.

Connected to frame (1) there can be seen, fixed to the base on which the plant components are arranged, a lower cross-member (2), a lifting beam (3), two lateral cross-members (4) and a fixed cross-member (12).

The lifting beam (3) is supported by the frame (1) and can be moved vertically by a lifting device (10) which, in this example, is electrical and is positioned on the top of the frame, but could also be hydraulic and positioned on the fixed cross-member, or be of some other arrangement.

In this constructional example, on the lifting beam (3) there are provided four upper cylinders (7) which carry the mould upper elements **(6*d*) relative to four moulds, and sixteen upper coupling devices (9)**.

In this embodiment the fixed cross-member (12) connected to the lower cross-member is at the center of the casting plant and extends as far as the upper cross-member of the frame (1), but could also be in an off-center position and be as tall as the lateral cross-members (4).

On each side of the fixed cross-member (12) there are provided locking rods (8) with the relative lateral mould elements **(6*b*) and (6*c*)** of adjacent moulds.

On the lower cross-member (2) there are provided four lower plates (5), which can be moved in a direction parallel to the cross member (2) or axial direction by carriages and are positioned respectively between two lateral element carriages (14), which are provided with locking rods (8) and on which the relative mould lateral element or first and second mold portion **(6*b*, 6*c*) are connected, so that the lower plate (5) and the lateral element carriage (14)** are alternately located one next to the other.

The mould sequence (6) terminates at the two ends with two lateral element carriages provided with a single row of locking rods (8) and arranged to house a single mould lateral element **(6*b*/6*c*), there being on the opposite side a lateral plate for redistributing the forces generated by the lateral cylinders (11) uniformly over the entire mould surface, during the clamping of the moulds (6)**.

The terminal part consists respectively of two lateral cross-members (4) with axial clamping devices, the lateral cylinders (11) of which act on mould groups to clamp the moulds (6) one against another.

The mould lower elements or third mold portions **(6*a*) are located on the lower plates (5), lateral elements (6*b*, 6*c*) of the moulds (6) being located on the lateral element carriages (14)**.

The plant components positioned on the lower cross-member (2) can be drawn together by being slid along the cross-member to form a mould group.

At the plant ends, the lateral cross-members (4) comprise a fixing device (13) which projects below the lower cross-member (2) with which it makes intimate contact at the moment in which the plant is completely clamped.

Figure 2:
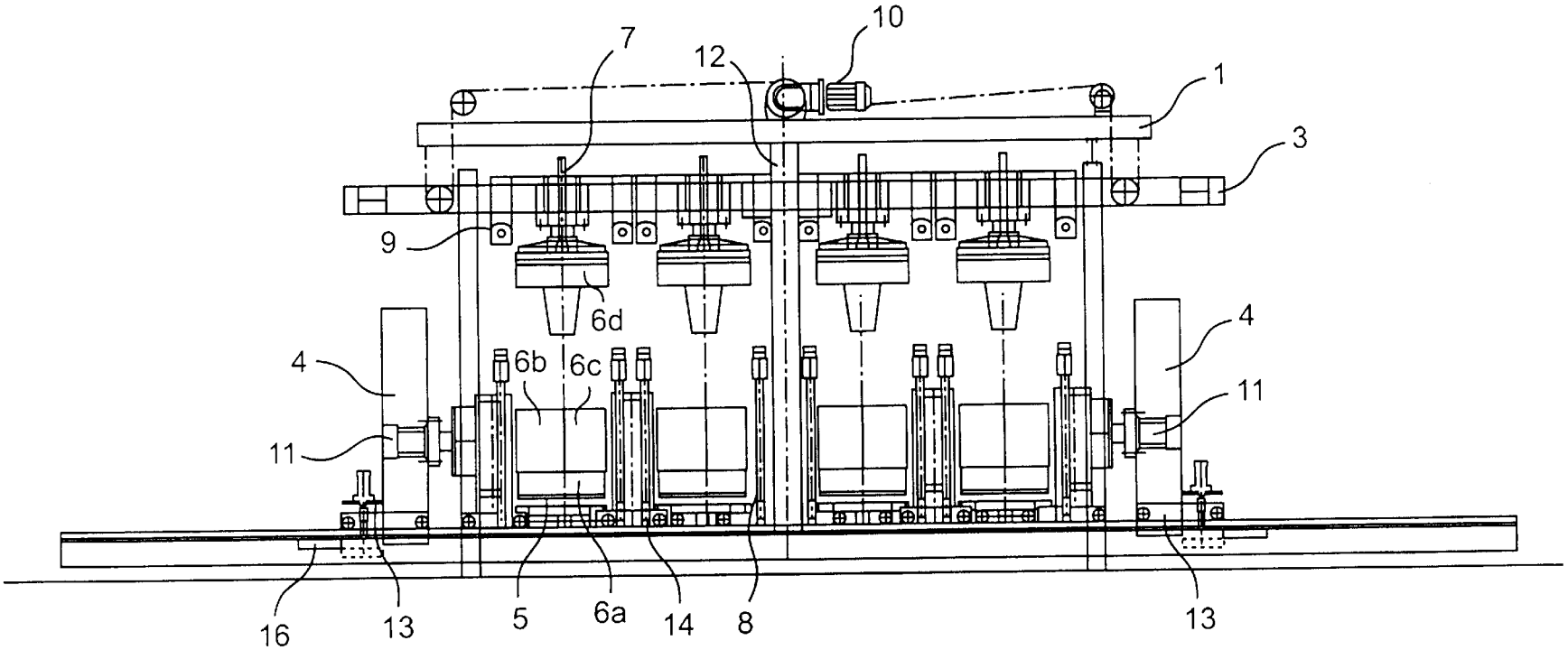
FIG. 2 is a front view of the plant with the moulds compacted in the axial direction.

To arrange the casting plant, the plant components situated on the lower cross-member (2) are brought into contact (see FIG. 2), after which the lifting beam (3) is lowered to engage the lateral cross-members (4) and the fixed cross-member (12).

The lateral cross-members (4) are then fixed by the fixing device (13) which rests against the stop (16) below the lower cross-member (2).

The lateral cylinders (11) are then pressurized to laterally compress the mould group formed in this manner, until the lateral carriage elements (14) with their locking rods (8) are below the coupling devices (9) which are rigid with the upper frames (15) connected to the lifting beam (3) by the weight compensation devices (24).

In this position the coupling devices (9) interact with the locking rods (8), for example by the automatic insertion of a pin therein.

The weight compensation devices (24) are operated.

Figure 3:
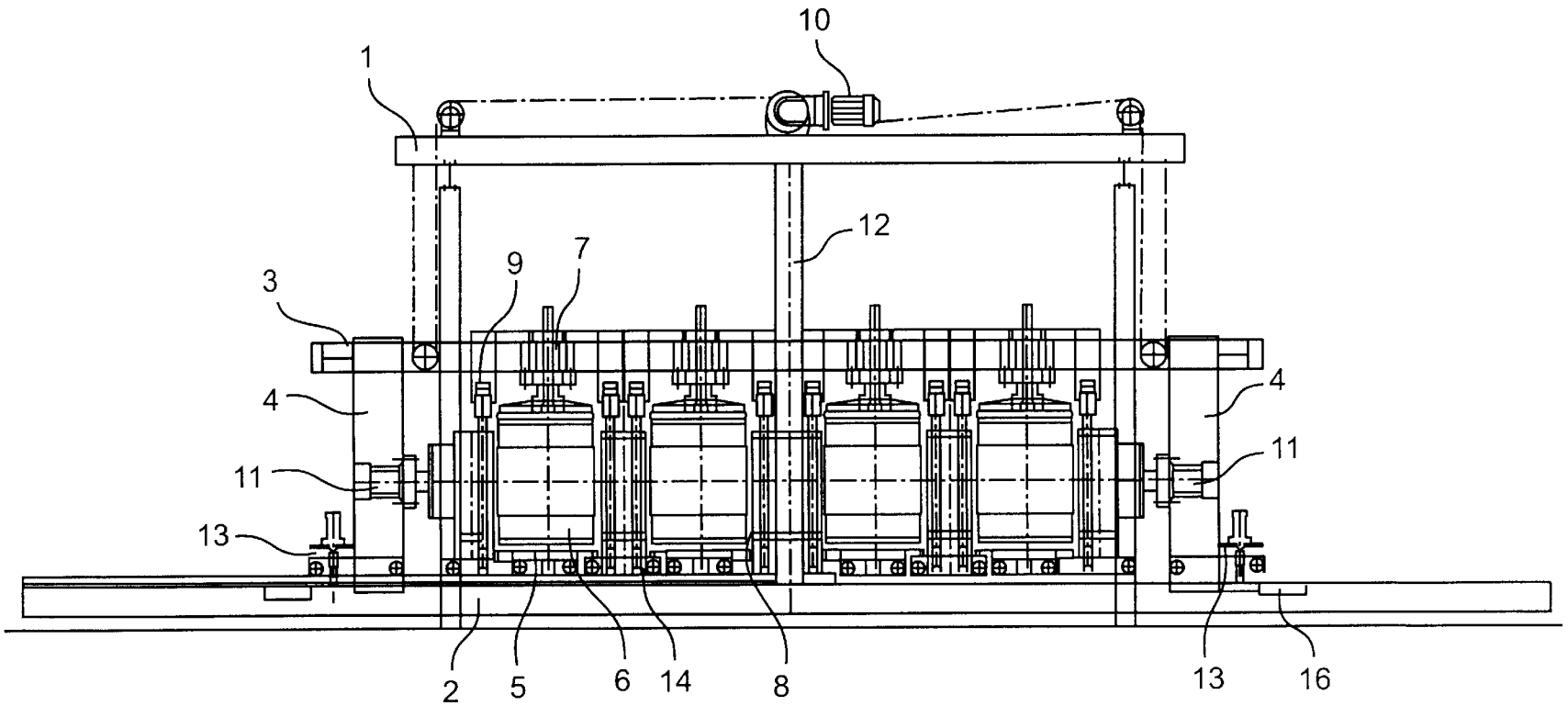
FIG. 3 is a front view of the plant with the moulds completely closed.

The upper cylinders (7) are lowered until the upper element or fourth mold portion **(6*d*) rests on the mould elements (6*b*, 6*c*). At this point, by means of the locking rods (8) and the reaction to the force of the upper cylinders (7), the lower plates rise to cause the lower mold elements (6*a*) to rest against the underside of the mould elements (6*b*, 6*c*). This position is shown in FIG. 3**.

Finally the pressure in the upper cylinders (7) and in the lateral cylinders (11) is increased until the moulds (6) become clamped with the necessary force for the pressure casting.

At this point the casting cycle can proceed.

After the articles, in this case water closet bowls, have been automatically cast, the plant is opened by the reverse of the aforedescribed operations.

The lateral cylinders (11) and upper cylinders (7) are slightly released, the upper cylinders (7) are completely opened, the pins of the upper coupling device (9) are automatically extracted, the lifting beam (3) is raised and the lateral cylinders (11) are completely opened.

The formed products, ie the water closet bowls, are detached from the moulds **(6*b*, 6*c*) with the lateral element detachment device (22) (see FIG. 4**) and can be withdrawn after the casting plant has been completely opened.

The individual elements of the moulds (6) are rinsed and the plant is again recomposed in the lateral direction and locked by the lifting beam (3), after which a new casting cycle can commence.

Figure 4:
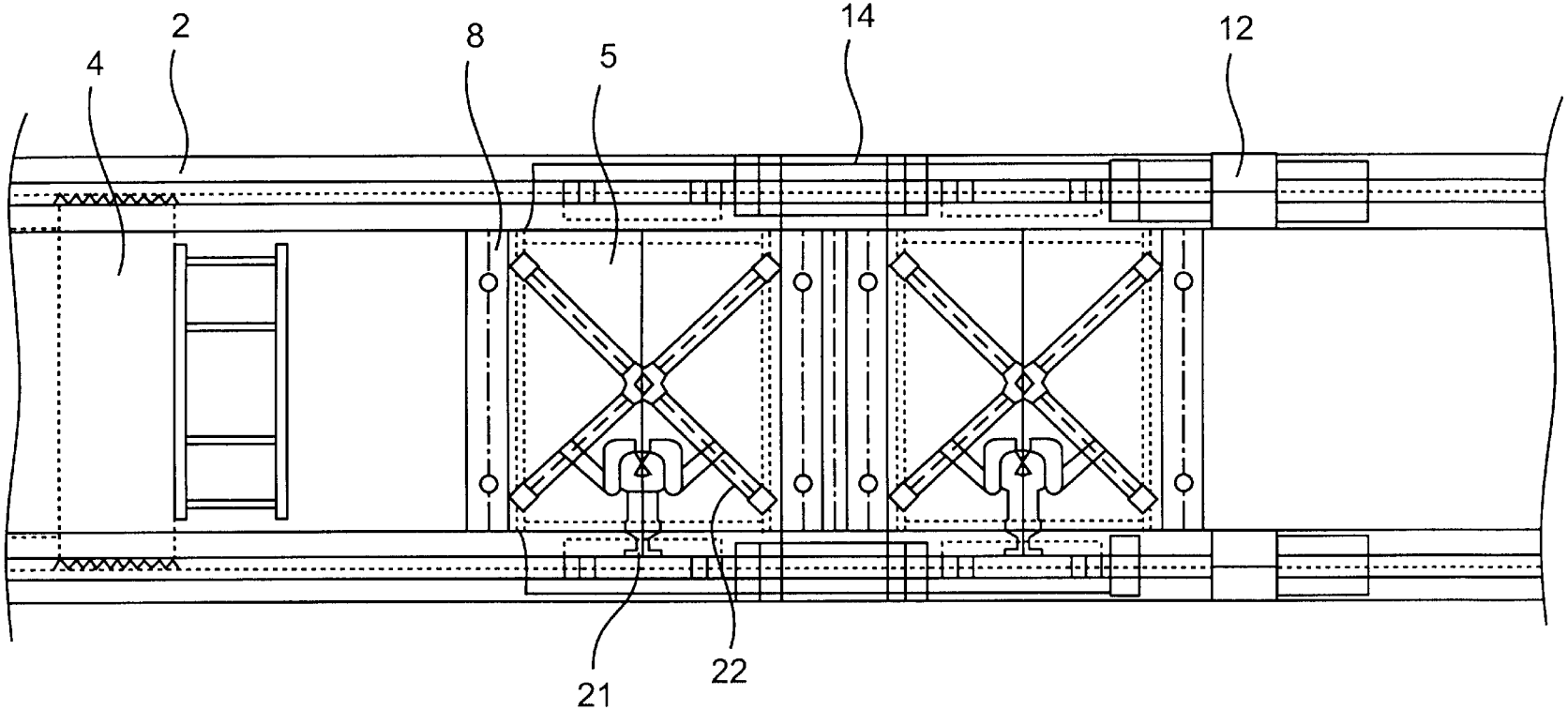
FIG. 4 is a view of the lateral element detachment device present below the lower plates.

FIG. 4 is a view of the lower plate (5) from below. This shows a scissor-type lateral element detachment device (22), the drive device (21) of which is operated in accordance with the movement of the lateral cross-member (4).

On opening the casting plant, the elements (22) of the scissor device are moved towards the plant longitudinal axis parallel to the beam 3 so that the two adjacent lateral element carriages (14) can be easily moved in the direction of the plant axis in opposite senses. As the mould lateral elements (6*b*, 6*c*) are fixed to the lateral element carriages (14), these become detached from the formed products, which remain rigid with the lower plates (5). The mould elements (6*a*, 6*b* and 6*c*) are hence already separated at the moment in which the plant is completely open.

Figure 5A:
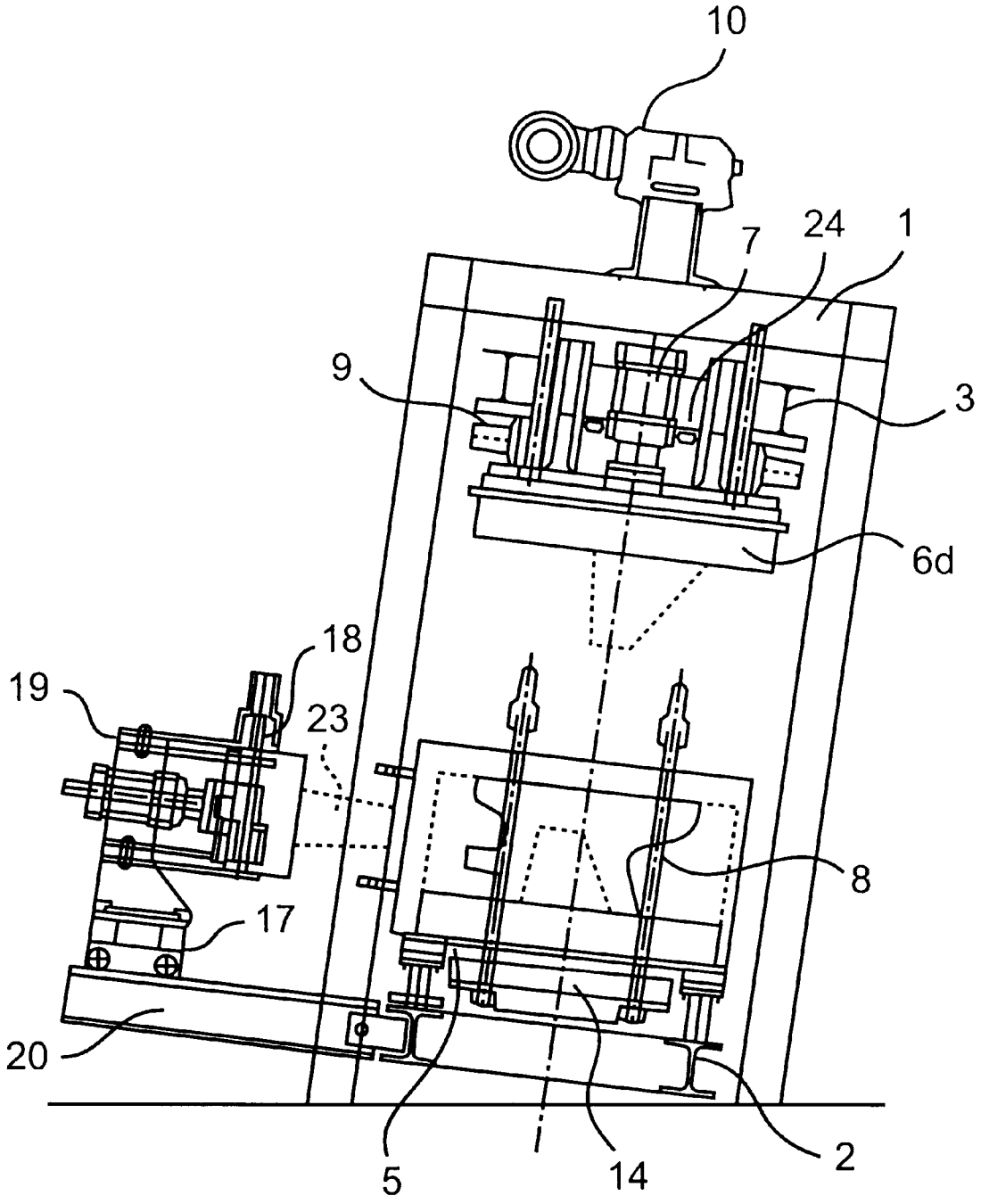
FIGS. 5A and 5B are side views of the open plant and clamped plant, showing the traditional clamping device.
Figure 5B:
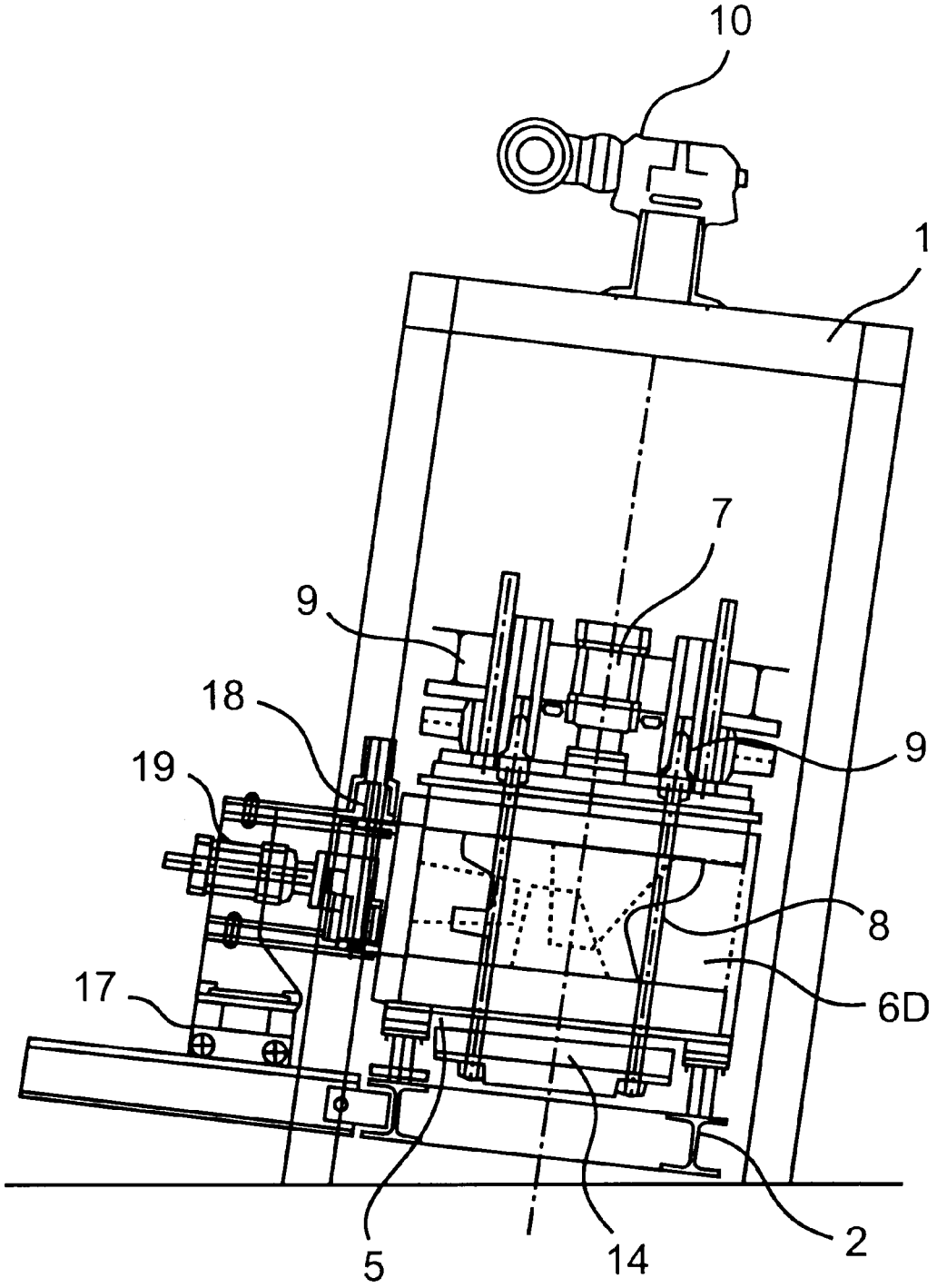

FIGS. 5A and 5B show a side view of the casting plant when opened and closed.

The device for clamping the casting plant transversely to the axial direction can be seen.

The transverse carriages (17) travel along the transverse guide (20) towards the moulds (6) present in the mould group. The transverse cylinder (19) is rigid with the mould transverse element or fifth mold portion (23) which is coupled to the other mould elements by hooking the transverse carriages (17) to the lateral element carriages (14) by means of the transverse coupling devices (18). As in the case of the upper coupling devices (9), these transverse coupling devices (18) are free to move in a direction axial to the plant.

These figures show the usual inclination for this type of plant, which is provided in order to easily discharge the casting material residues. The plant shown in FIG. 5B is clamped in three directions.

Given the simplification of the clamping devices, this type of plant allows a considerably higher productivity than previously illustrated plants. The casting plant according to the present invention comprises less clamping devices than previously known plants, and a much smaller number of wearable parts.

The individual characteristics of the present invention can be widely modified without limiting its range of protection. The individual coupling devices can be implemented by pins, hooks, etc. The operation of the locking and/or coupling and/or fixing devices can be pneumatic, electromechanical, electromagnetic or the like.

Correlation between the operation of the lateral element detachment devices and the movement of the lateral cross-members or of the fixing and/or locking devices can be achieved by any suitable device. The lateral element detachment device can also be based on other principles, such as by pressurizing the cylinders situated below the lower plates at the moment of slackening the pressure casting plant, and causing them to thus urge the cylinder carriages. Mould opening could also be achieved by a varying pressure causing slight vibrations in order to more easily detach the formed products.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pressure casting apparatus for molding articles comprising:

a cross-member extending in a first direction; at least two carriages slidingly moveable on said cross-member, with each carriage including: first and second portions of a mold fixed back-to-back on said carriage; and at least two locking rods extending in a second direction, substantially perpendicular to said first direction;

at least one plate slidingly moveable on said cross-member, , said at least one plate being located between said at least two carriages, with each plate including: a third portion of a mold supported thereon;

two lateral cross-members slidingly moveable on said cross-member, said lateral cross-members having said at least two carriages and said at least one plate located therebetween, each lateral cross-member including: a lock for engaging with a portion of said cross-member or a stop attached to said portion of said cross-member; at least one lateral cross-member including: a first powered actuator for applying a force between said at least one lateral cross-member and an adjacent carriage;

a frame fixed to said cross-member; and a beam supported by said frame, said beam being movable between a remote position and a close position while remaining substantially parallel to said cross-member; said beam including: at least four couplers attached to said beam; a second powered actuator attached to said beam; and a fourth portion of a mold attached to said second powered actuator, such that said fourth portion of said mold can be moved away from said beam;

wherein when said two lateral cross-members, at least two carriages, and at least one plate are located close to one another, said lock is engaged with said portion of said cross-member or said stop attached to said portion of said cross-member, and said beam is in said close position; said two lateral cross-members are engaged by said beam in order to prevent movement of said lateral cross-members in directions away from one another, and said locking rods of said at least two carriages are engaged to said couplers attached to said beam.

2. The apparatus as claimed in claim 1, wherein actuation of said second actuator to move fourth portion of said mold causes said third portion of said mold to close against said first and second portions of said mold, due to the engagement of said locking rods and said couplers.

3. The apparatus as claimed in claim 1, wherein each lateral cross-member of said two lateral cross-members includes a respective first powered actuator for applying a force between said lateral cross-member and an adjacent carriage.

4. The apparatus as claimed in claim 1, wherein said first, second, third and fourth portions of said mold are made of a synthetic material.

5. The apparatus as claimed in claim 1, further comprising:

a transverse provided adjacent to said at least one plate for inserting a fifth portion of said mold adjacent to said first and second portions of said mold.

6. The apparatus as claimed in claim 5, wherein said transverse carriage includes a locking device causing said fifth portion of said mold to clamp with said first, second, third and fourth portions of said mold.

7. The apparatus as claimed in claim 1, further comprising:

a fixed cross-member extending between said cross-member and said frame, dividing said apparatus into molding groups containing at least two molds each.

8. The apparatus as claimed in claim 7, wherein a first portion of a mold and at least one locking rod is affixed to one said of said fixed cross-member and a second portion of a mold and at least one locking rod is affixed to an opposite side of said fixed cross-member.

9. The apparatus as claimed in claim 1, wherein below the plates there is provided a lateral element detachment device which is inactive at the moment of clamping the mold portions together, and active against the adjacent carriage at the moment when the molds are opened, so that the carriages can be slightly detached from the plates on which the third mold portion is positioned.

10. The apparatus as claimed in claim 9, wherein the lateral element detachment device comprises a scissors device, the elements of which are slackened during the clamping of the mold portions, and urged towards the adjacent lateral carriages at the moment when the molds are slackened.

11. The apparatus as claimed in claim 10, wherein the lateral element detachment device is provided with a driver which is synchronized with one of said first and second actuators.

12. The apparatus as claimed in claim 11, wherein the driver of the lateral element detachment device is synchronized with said first actuator.

* * * * *